US006575424B2

(12) United States Patent
Domizio

(10) Patent No.: US 6,575,424 B2
(45) Date of Patent: Jun. 10, 2003

(54) VOID FORMING DEVICE

(76) Inventor: George Thomas Domizio, P.O. Box 736, Stevenson, CT (US) 06491

( * ) Notice: Subject to any disclaimer, the term of this patent is extended or adjusted under 35 U.S.C. 154(b) by 0 days.

(21) Appl. No.: 09/817,571

(22) Filed: Mar. 26, 2001

(65) Prior Publication Data

US 2002/0134905 A1 Sep. 26, 2002

(51) Int. Cl.[7] ..... B28B 7/06; B28B 7/16

(52) U.S. Cl. ..... 249/91; 249/96; 249/170; 249/177; 52/125.6

(58) Field of Search ..... 249/35, 83, 91, 249/93, 94, 96, 97, 142, 170, 177; 52/125.5, 706, 707

(56) References Cited

U.S. PATENT DOCUMENTS

| | | | |
|---|---|---|---|
| 1,045,587 | A | 11/1912 | Morley |
| 1,244,034 | A | 10/1917 | Cummings |
| 2,344,206 | A | 3/1944 | Forni |
| 2,350,767 | A | 6/1944 | Keating |
| 2,366,656 | A | 1/1945 | Saffert |
| 2,623,261 | A | 12/1952 | Semeraro |
| 3,065,570 | A | 11/1962 | Prizler et al. |
| 3,298,148 | A | 1/1967 | Dickson |
| 3,534,668 | A | 10/1970 | Scheincha |
| 3,731,902 | A | 5/1973 | Shoemaker |
| 4,087,947 | A | 5/1978 | Turner |
| 4,296,909 | A | 10/1981 | Haeussler |
| 4,580,378 | A | 4/1986 | Kelly et al. |
| 4,797,081 | A | 1/1989 | Prater |
| 4,821,994 | A | 4/1989 | Fricker |
| 5,004,208 | A | 4/1991 | Domizio |
| 5,651,911 | A | 7/1997 | Pennypacker |
| 6,082,700 | A | 7/2000 | Lancelot, III et al. |

FOREIGN PATENT DOCUMENTS

| | | |
|---|---|---|
| DE | 3629772 | 3/1988 |
| SU | 554163 | 4/1977 |

*Primary Examiner*—James P. Mackey
*Assistant Examiner*—Donald Heckenberg
(74) *Attorney, Agent, or Firm*—Bachman & LaPointe, P.C.

(57) ABSTRACT

An apparatus for supporting a lift member in a concrete mold includes a resilient member having a void forming portion and a lift member receptacle for releasably holding a lift member and a mounting plate having a front surface and a rear surface and adapted for receiving the resilient member from the rear surface with the void forming portion extending from the front surface, the mounting plate having mounting structure on the rear surface for mounting to a concrete mold.

18 Claims, 4 Drawing Sheets

VOID FORMING DEVICE

BACKGROUND OF THE INVENTION

The invention relates to a void forming device and, more particularly, to a device for supporting a lift member relative to a concrete mold and a device for forming a void in the concrete around the member so as to provide an exposed lift member in the resulting concrete product.

Precast concrete products are used in numerous construction projects and are desirably provided with lift members such as rings or sections of rebar which can be used to lift the precast concrete product in the process of positioning the precast concrete product where desired.

Devices for use in embedding lift members into concrete products are disclosed in U.S. Pat. No. 5,004,208 to DoMizio, U.S. Pat. No. 5,651,911 to Pennypacker, U.S. Pat. No. 4,580,378 to Kelly et al., U.S. Pat. No. 3,065,576 to Prizler et al., U.S. Pat. No. 2,344,206 to Forni, and others. Typically, some form of void forming member is positioned within a concrete mold, and a lift element such as a ring or section of rebar is supported so as to be exposed through the void formed by the void forming member such that the ring or rebar member can be used to lift the precast concrete member.

One persistent problem in the art is related to the proper positioning of the void forming device and lift member relative to the mold. A number of the aforementioned devices are handheld devices which obviously must be held in place by a person. This results in the need for personnel to hold the device in place for a suitable amount of time, and also can only be used in areas which are accessible by hand.

Others in the aforementioned group of patents are designed to be secured within the mold. Unfortunately, these devices typically require holes to be drilled through the walls of the mold so that the void-forming members can be secured in place as desired. Clearly, this can lead to a severe shortening in the useful life of the mold.

It is common during the pouring of concrete into molds to cause a shaking of the mold so as to insure good distribution of the concrete throughout the mold. Unfortunately, this tends to shake lift members or rings free from conventional devices such as those described above.

It is clear that the need remains for an apparatus for embedding lift members into precast concrete products which can be positioned in a wide variety of different places within a mold, while avoiding the need for drilling holes in same.

It is a further object of the present invention to provide such an apparatus which firmly holds the lift member relative to the mold.

It is another object of the present invention to provide such an apparatus which can be positioned on curved mold surfaces.

Other objects and advantages of the present invention will appear hereinbelow.

SUMMARY OF THE INVENTION

In accordance with the present invention, the foregoing objects and advantages have been readily attained.

According to the invention, an apparatus is provided for supporting a lift member in a concrete mold, which apparatus comprises a resilient member having a void forming portion and a lift member receptacle for releasably holding a lift member, and a mounting plate having a front surface and a rear surface and adapted for receiving said resilient member from said rear surface with said void forming portion extending from said front surface, said mounting plate having mounting structure on said rear surface for mounting to a concrete mold.

In accordance with a preferred aspect of the present invention, the mounting structure is advantageously provided in the form of mechanical fasteners, magnetic fasteners, and combinations thereof. The mounting plate of the present invention is particularly advantageous because it is designed to be useful with any of these types of mounting devices, and therefor can be used to provide enhanced versatility during preparation of precast concrete products.

In accordance with still another aspect of the present invention, a handle attachment may be provided for hand-held use.

In accordance with still another aspect of the present invention, the resilient member is preferably provided in the form of a base portion and to void forming elements extending from the base portion so as to define the void forming portion. Each of the two void forming elements has a surface facing the other of the two void forming elements so as to define a slot and the lift member receptacle therebetween. In this embodiment, the mounting plate may advantageously be provided with dowel members extending from the front surface thereof such that the dowel members extend into the void forming elements on either side of the lift member receptacle so as to exert a holding force through the resilient member to a lift member in the lift member receptacle, thereby advantageously holding the lift member against dislodging, for example while the mold is being shaken.

BRIEF DESCRIPTION OF DRAWINGS

A detailed description of preferred embodiments of the present invention follows, with reference to the attached drawings, wherein.

DETAILED DESCRIPTION

The invention relates to void forming and lift-member embedding devices and, more particularly, to a device adapted for positioning relative to a concrete mold so as to embed a lift member into a concrete precast article formed in the mold, and so as to form a void in the article around a portion of the lift member so as to facilitate lifting of the article by hooking to the embedded lift member.

Figure 1:
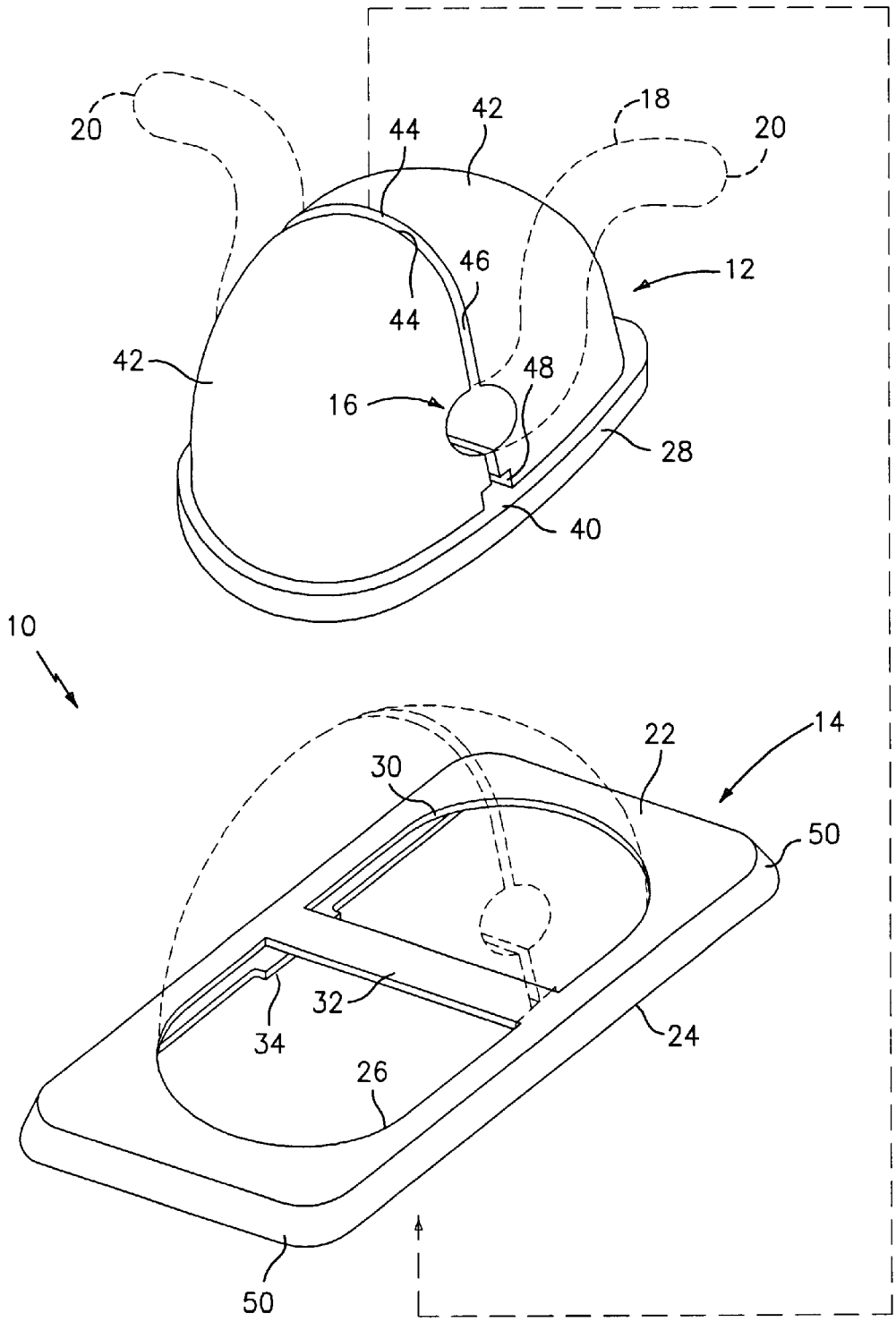
FIG. 1 shows an exploded perspective view of an apparatus in accordance with the present invention.

FIG. 1 shows an apparatus 10 in accordance with the present invention and including a resilient member 12 which will be further discussed below and a mounting plate 14 which is suitable for mounting resilient member 12 to a wall of a mold, for example a mold for forming precast concrete products.

As shown, resilient member 12 preferably has a substantially smooth-walled void forming portion, in this instance shaped as a portion of a rounded disc, and further includes a receptacle 16 which is adapted for holding a lift member 18, for example as shown in FIG. 1 in dashed lines, in place while liquid concrete or other moldable material is poured into the mold. In accordance with the invention, once the moldable material has sufficiently solidified, resilient member 12 is removed leaving lift member 18 embedded into the resulting molded or precast product, with portions 20, in this case extending legs of lift member 18, embedded into the solidified material, and with the portion embraced by resilient member 12 exposed through a void formed in the resulting article such that lift member 18 can be used in lifting or otherwise connecting to the precast or molded article.

Mounting plate 14 is preferably a substantially flat member adapted to receive and hold resilient member 12 and to be secured through one or more mechanisms to a wall of the mold.

As shown, mounting plate 14 has a front surface 22 through which resilient member 12 extends when inserted through mounting plate 14 as shown in FIG. 1 (and also as shown in dashed lines in FIG. 1), and a rear surface 24 adapted to interact with various types of fasteners for use in securing apparatus 10 to a wall of the mold as desired.

Figure 2:
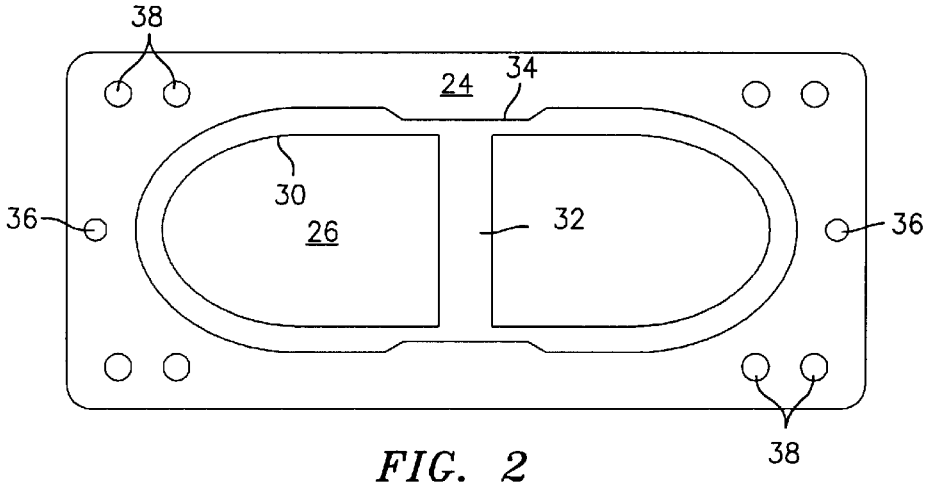
FIG. 2 shows a bottom view of a mounting plate in accordance with the present invention.

Referring also to FIG. 2, mounting plate 14 preferably includes a centrally located opening 26 through which resilient member 12 is inserted from the rear as shown in FIG. 1. Resilient member 12 and mounting plate 14 preferably have structure adapted to securely hold resilient member 12 within opening 26 during use of apparatus 10 as desired. For example, resilient member 12 may preferably have a substantially outwardly extending flange 28 and mounting plate 14 may advantageously have an inwardly directed lip member 30 which engages against flange 28 when resilient member 12 is inserted into mounting plate 14 from the rear so as to prevent resilient member 12 from removal through the front surface 22 of mounting plate 14. In further accordance with this embodiment of the present invention, mounting plate 14 may advantageously have a transverse member 32 which is further positioned to interact with resilient member 12 as will be further discussed below.

In further accordance with the invention, mounting plate 14 may advantageously have one or more rear lip portions 34 which are spaced from lip member 30 and which extend inwardly relative to opening 26. Lip member 30 and rear lip portions 34 are preferably spaced so as to receive flange 28 of resilient member 12 therebetween (see also FIG. 12). Lip portions 34 are advantageously provided over only a portion of the perimeter of opening 26 so that resilient member 12 can be snapped into place. Of course, lip portions 34 can be positioned in different locations and/or could be provided around the entire perimeter opening 26, if desired.

Still referring to FIG. 2, mounting plate 14 preferably has various structure on rear surface 24 to allow use of different types of mounting structures so as to mount mounting plate 14 to the wall of a mold. Thus, as shown in FIG. 2, mounting plate 14 may advantageously have threaded sockets 36 for use in receiving conventional threaded fasteners which could be used to secure mounting plate 14 at a position where holes have been provided in the wall of the mold. Alternatively and/or in addition, rear surface 24 of mounting plate 14 advantageously can be provided with sockets 38 for holding magnetic members that can be used to secure mounting plate 14 to mold walls formed from ferrous material. In this manner, mounting plate 14 can be positioned in a ferrous-walled mold in a wide variety of different locations without requiring the drilling of additional holes in the mold walls.

FIG. 2 shows mounting plate 14 having threaded sockets 36 centered at each end of mounting plate 14, and with sockets positioned in pairs at each corner. Of course, threaded sockets 36 and sockets 38 for magnets could be positioned elsewhere on rear surface 24, well within the scope of the present invention.

Still referring to FIG. 1, resilient member 12 in accordance with the present invention preferably has a base member 40 from which flange 28 may advantageously extend radially outwardly, and two void forming elements 42 which extend from base member 40, each having an opposing face 44 which is positioned so as to oppose the face 44 of the other void forming element 42. Further, each void forming element 42 is preferably provided with a portion of receptacle 16 such that surfaces 44 define a slot 46 therebetween and, in combination, define receptacle 16 for holding a lift member 18.

In further accordance with the present invention, resilient member 12 may advantageously have a cutout portion 48 positioned to the front of base member 40 for receiving transverse member 32 so as to firmly hold resilient member 12 in place within mounting plate 14 as desired.

As shown, each void forming element 42 may advantageously form a portion of the void forming member of resilient member 12 as desired.

Resilient member 12 may advantageously be provided from any sufficiently flexible material such as would be well known to a person of ordinary skill in the art. The flexibility is desirable so that resilient member 12 can be flexed during positioning into mounting plate 14 and during positioning of lift member 18 into receptacle 16. The flexibility is further important during removal of apparatus 10 from a solidified molded product. Assembly and disassembly utilizing this flexibility is further described in connection with FIGS. 3 and 8 below.

Mounting plate 14 may be provided of any suitably rigid material such as aluminum, stainless steel and the like. This material should be selected so as to be sufficiently durable for the intended use, preferably while minimizing costs due to manufacturing concerns and the like. It should also be noted that mounting plate 14 is advantageously provided having substantially rounded outward edges 50 such that the void formed in the molded product has an acceptably smooth profile, and further to facilitate removal of mounting plate 14 along with resilient member 12.

Figure 3:
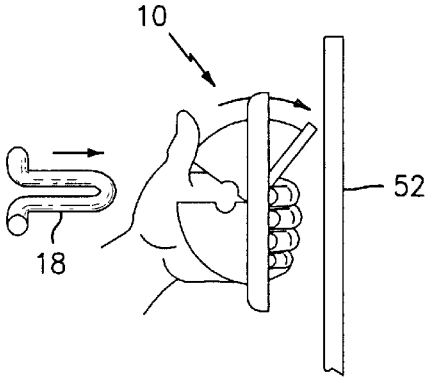
FIG. 3 illustrates assembly of an apparatus in accordance with the present invention.

Turning now to FIG. 3, the assembly of an apparatus 10 for use in accordance with the present invention is illustrated.

As shown, resilient member 12 is pivoted about a hinge point defined between void forming elements 42 so as to position transverse member 32 in cutout 48 and flange 28 between lip member 30 and rear lip portions 34. With one void forming element 42 still pivoted away, a lift member 18 is positioned within receptacle 16 as shown. Once lift member 18 is positioned in receptacle 16, the last void forming element 42 is snapped into position with flange 28 between lift members 30, 34, and apparatus 10 is now ready for securing to the wall 52 of a mold.

Figure 4:
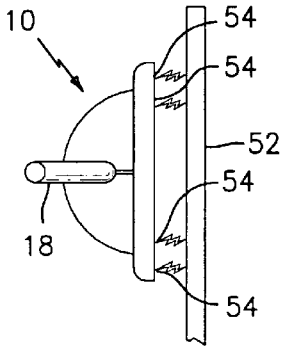
FIG. 4 illustrates magnetic securing of an apparatus in accordance with the present invention to a mold wall structure.

FIG. 4 illustrates the mounting of apparatus 10 to wall 52 using magnetic fasteners. In this embodiment, magnets 54 are positioned within sockets 38 and apparatus 10 is then magnetically held to any ferrous portion of wall 52 as desired. In this regard, suitable magnets 54 should be selected such that apparatus 10 is firmly held and will not move or shift due to shaking of the mold and the like which may be necessary to provide for sufficient distribution of fluid concrete poured into the mold. Neodymium magnets are particularly preferred, although other types of magnets can be used as well.

Figure 5:
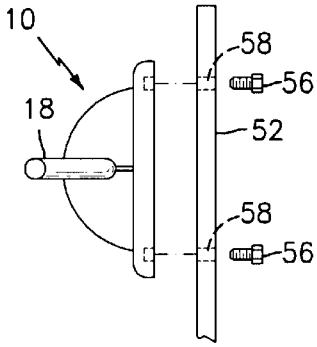
FIG. 5 illustrates attachment of an apparatus according to the invention to a mold wall structure utilizing threaded fasteners.

FIG. 5 shows apparatus 10 being secured to wall 52 utilizing conventional threaded fasteners 56 which are positioned through holes 58 in wall 52 and engaged with threaded sockets 36 as desired.

In the embodiments of FIGS. 4 and 5, once concrete has been poured and allowed to solidify, the mold wall 52 can be removed from the molded article and apparatus 10 can then be removed as well. In the magnetic version, magnets 54 will most likely pull away with wall 52, leaving apparatus 10 for removal as will be illustrated further below. With the embodiment of FIG. 5, the threaded fasteners 56 should be removed before walls 52 are removed from the molded article.

In connection with the embodiment of FIG. 5, it should of course be appreciated that different types of threaded fasteners could be used. It is most preferred, however, to provide threaded sockets 36 as shown so that such threaded sockets do not interfere with mounting of mounting plate 14 if magnetic fasteners are to be used.

Figure 6:
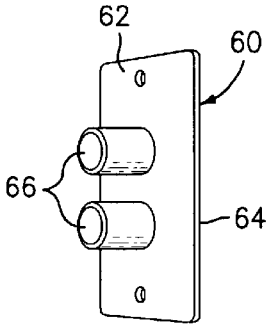
FIG. 6 is a perspective view of an intermediate mounting plate in accordance with the present invention.
Figure 7:
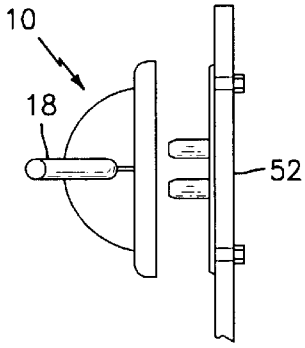
FIG. 7 is a side view of an apparatus in accordance with the present invention being mounted to a mold using the intermediate mounting plate of FIG. 6.

Turning now to FIGS. 6 and 7, in one aspect of the present invention, an intermediate mounting plate 60 is provided. Intermediate mounting plate 60 advantageously has a front surface 62 and a rear surface 64, with two extending members or dowels 66 extending from front surface 62 for use in engaging resilient member 12 and/or mounting plate 14. In this embodiment, rear surface 64 of intermediate mounting plate 60 is configured similarly to rear surface 24 of mounting plate 14 for use in mechanical or magnetic fastening to wall 52 of the mold. In this embodiment, dowels 66 are preferably positioned so as to extend through mounting plate 14 and into void forming element 42 of resilient member 12, preferably on either side of slot 46 and receptacle 16. Dowels 66 are advantageously spaced from each other so as to firmly engage a lift member 18 through resilient member 12 such that dowels 66 help to prevent lift member 18 from being dislodged from receptacle 16 during the concrete pouring and/or shaking process.

As shown in FIG. 7, intermediate mounting plate 60 can be mounted to wall 52 using threaded fasteners, magnets or any other suitable mounting structure, and will snap free of apparatus 10 when wall 52 is removed from the molded article.

In accordance with a further embodiment of the present invention, it should be noted that structures such as dowels 66 can advantageously be provided on mounting plate 14 if desired so as to provide the desired advantage of holding lift member 18 in place and receptacle 16 in embodiments that do not use an intermediate mounting plate 60.

Figure 8:
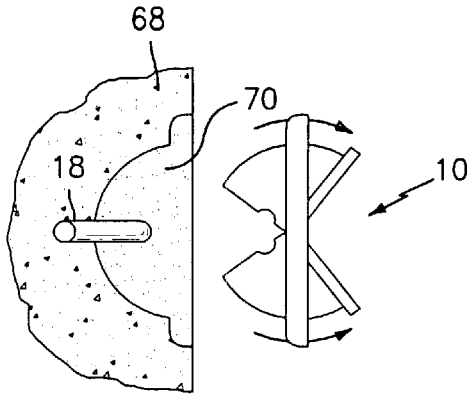
FIG. 8 illustrates removal of the apparatus of the present invention from a precast article and shows the resulting lifting member exposed for use in lifting the article as desired.

Turning now to FIG. 8, removal of apparatus 10 from a solidified article 68 is illustrated. As discussed above, wall 52 has already been removed, as have been any remaining threaded fasteners or intermediate mounting plates 60. At this point, resilient member 12 is pulled outwardly away form solidified article 68 as shown by the arrows in FIG. 8 so as to pivot void forming elements 42 relative to each other at the portion of base 40 that joins these members. Pivoting of resilient member 12 in this manner serves to open receptacle 16 and release lift member 18 from resilient member 12, and further serves to loosen resilient member 12 from any surface adhesion or contact with a solidified material of solidified article 68. Mounting plate 14 and resilient member 12 can then be removed from solidified article 68 as desired leaving lift member 18 embedded into solidified article 68 as shown with a void 70 formed around a suitable portion of lift member 18, also as desired and having a profile as defined by resilient member 12 and front surface 22 of mounting plate 14.

Apparatus 10 can then advantageously be used in accordance with the present invention for positioning of additional lift members 18 in subsequent articles to be molded all in accordance with the present invention.

Figure 9:
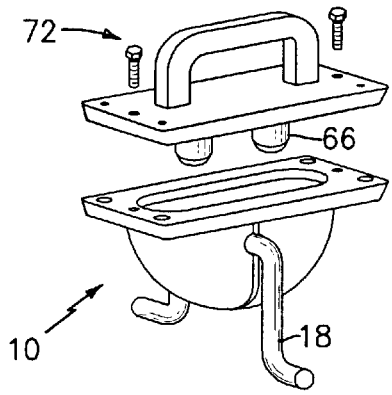
FIG. 9 illustrates a further embodiment of the present invention including a handle attachment.

Turning now to FIG. 9, a further embodiment of the present invention is illustrated. In this embodiment, a handle member 72 is provided and adapted for securing to resilient member 12 either directly or through mounting plate 14. In the embodiment shown in FIG. 9, handle member 72 is adapted for bolting to mounting plate 14 using conventional threaded fasteners 56 and is further provided with dowels 66 which extend into resilient member 12 as discussed above so as to provide for a firm holding of lift member 18 within receptacle 16 as desired. Handle member 72 can also be connected to mounting plate 14 utilizing magnetic fasteners as discussed above, or any other suitable structure. This embodiment allows for apparatus 10 to be used to embed lift member 18 into an article to be formed at positions other than surfaces in contact with mold walls. Of course, handle member 72 is advantageous in that it allows resilient member 12 and mounting plate 14 to be used in both mold wall mounted environments and hand-held environments, without requiring any structural changes to resilient member 12 and mounting plate 14.

Figure 10:
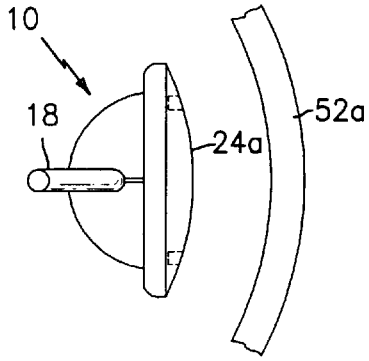
FIGS. 10 and 11 illustrate an embodiment of the present invention adapted for use with curved mold wall surfaces.
Figure 11:
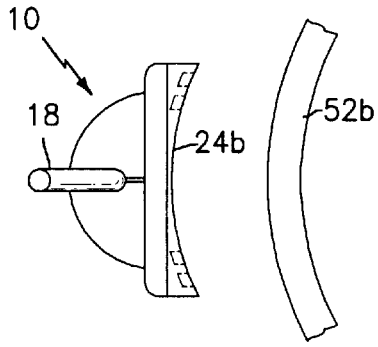

Turning now to FIGS. 10 and 11, additional mounting plates 14*a*, 14*b* are provided in accordance with the present invention which are similar to the structure in FIGS. 1 and 2, but which have arcuate rear surfaces 24*a*, 24*b*, which are adapted for mounting to curved wall sections 52*a*, 52*b*. This advantageously allows for apparatus 10 to be mounted to non-flat portions of a mold. In this regard, mounting plate 14 is provided having rear surface 24 machined to the proper radius of curvature as dictated by the curved mold surface, either concave outwardly or convex outwardly, so as to adapt to the desired environment of use. FIGS. 10 and 11 show curved surface 24*a, b* along the long dimension of mounting plate 14. Of course, the curved surface may be provided along the short dimension of mounting plate 14 as well. In the embodiment shown, the curved surface 24*a*, 24*b* is curved about a radius oriented substantially laterally as shown, while alternatively the surface could be curved about a radius oriented longitudinally, and such an embodiment may be preferable in some instances.

The embodiments of FIGS. 10 and 11 are used in all other respects in the same manner as the embodiments described above.

Figure 12:
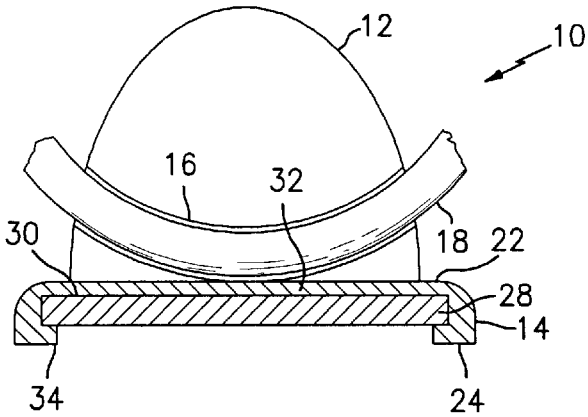
FIG. 12 further illustrates a preferred embodiment of the present invention.

Turning now to FIG. 12, a cross sectional view is provided showing additional detail of the interaction between resilient member 12 and mounting plate 14, and further showing additional structure of surface 44 of a void forming element 42 of resilient member 12. Thus, FIG. 12 shows base member 40 of resilient member 12 held between lip member 30 and transverse member 32 on one side and rear lip portions on the other side so as to hold resilient member 12 within mounting plate 14 against removal in a direction directed toward front surface 22 of mounting plate 14, while allowing removal of resilient member 12 from mounting plate 14 in a direction directed toward rear surface 24 from front surface 22 of mounting plate 14.

FIG. 12 further illustrates an advantageous and preferred structure of receptacle 16. The preferred form of lift member 18 includes a substantially curved central portion as best shown in FIG. 3, with outwardly extending legs adapted for secure embedding into the molded article. Because central portion is curved, it is preferred to provide receptacle 16 having a substantially matching curve as shown in FIG. 12 so as to more snuggly and firmly hold lift member 18 and receptacle 16 as desired. The remaining portion of surface 44 is preferably provided as a substantially smooth flat surface such that surfaces 44 contact each other while apparatus 10 is in use and prevent concrete from flowing into slot 46 and interfering with the desired void 70 (FIG. 8) that is desired to be formed.

Returning to FIG. 9*a*, a further aspect of the present invention is drawn to a handle member 72 adapted with structure to allow for outward pivot of dowels relative to each other which thereby facilitates removal of handle member 72 from apparatus 10 as desired. In this regard, any suitable structure can be used to generate the outward pivot of dowels 66 as desired.

Figure 9A:
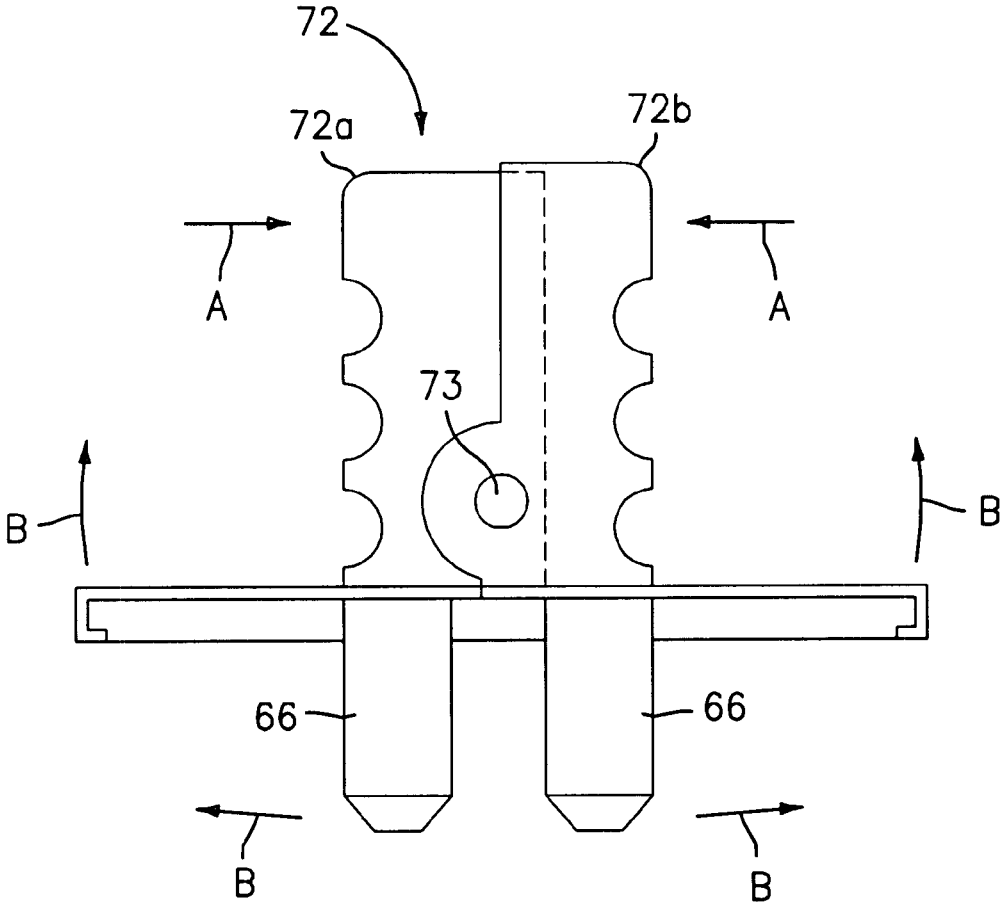
FIG. 9*a* illustrates a further embodiment of a handle member according to the present invention.

FIG. 9*a* shows handle member 72 having two handle portions 72*a*, 72*b* which are pivotably mounted together, for example at pivot point 73. A spring member may suitably be positioned within hollow handle portions 72*a*, 72*b* so as to bias handle member 72 to the position shown, while allowing squeezing of handle portions 72*a*, 72*b* as shown by arrows A in FIG. 9*a* so as to spread dowels 66 as shown by arrows B to facilitate removal from apparatus 10. Relative pivot of handle portions 72*a*, 72*b* serves to pivot dowels 66 away from each other so as to remove the clamping force exerted through the resilient member on the anchor and help to remove handle 72 as desired.

It should be readily appreciated that an apparatus has been provided in accordance with the present invention which allows for a more versatile and reliable placement of lift members relative to walls of a mold as desired.

It should further be appreciated that the apparatus in accordance with the present invention is provided such that it can be mounted utilizing mechanical or magnetic fasteners, and can also be hand-held. The advantages of such a device stem from the versatility of its use and are readily apparent.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, wherein said mounting plate has a central opening for receiving said resilient member.

2. The apparatus according to claim 1, wherein the mounting structure includes at least one of the group consisting of mechanical fasteners, magnetic fasteners, and combinations thereof.

3. The apparatus according to claim 1, wherein the mounting structure comprises magnetic fasteners.

4. The apparatus according to claim 3, wherein said mounting plate has a plurality of recessed areas adapted for receiving said magnetic fasteners.

5. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, wherein the mounting structure comprises magnetic fasteners, wherein said mounting plate has a plurality of recessed areas adapted for receiving said magnetic fasteners, and wherein at least said recessed areas are formed of ferrous material whereby said magnetic fasteners are magnetically held in said recessed areas.

6. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, further comprising a setting handle member having a handle portion and structure for engaging said mounting structure of said mounting plate.

7. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, further comprising a mold-side mounting plate having a front surface and a rear surface, said mold-side mounting plate being adapted for securing to said concrete mold at said rear surface and said front surface being adapted to engage said mounting structure of said mounting plate.

8. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, wherein said resilient member has an outwardly extending flange portion and said mounting plate has an opening for receiving said resilient member and a lip extending inwardly from said opening for engaging said flange portion.

9. The apparatus according to claim 8, wherein said mounting plate further comprises an additional lip portion extending inwardly form said opening and spaced form said lip so as to receive said flange portion between said lip and said additional lip portion.

10. The apparatus according to claim 1, wherein said resilient member comprises a base portion and two void forming elements extending from said base portion so as to define said void forming portion, each one of said two void forming elements having a surface facing the other of said two void forming elements so as to define a slot and said lift member receptacle therebetween.

11. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, wherein said resilient member comprises a base portion and two void forming elements extending from said base portion so as to define said void forming portion, each one of said two void forming elements having a surface facing the other of said two void forming elements so as to define a slot and said lift member receptacle therebetween, wherein said mounting plate has an opening for receiving said resilient member and a transverse member extending across said opening for holding said resilient member in said opening.

12. The apparatus according to claim 11, wherein said transverse member extends through at least one of said slot and said lift member receptacle along a front surface of said base portion.

13. The apparatus according to claim 10, wherein said mounting plate has two dowel members extending from said front surface whereby said two dowel members extend into said void forming elements on either side of said lift member receptacle so as to exert a holding force through said resilient member to a lift member in said lift member receptacle.

14. The apparatus according to claim 1, wherein said lift member receptacle is substantially round in cross section for receiving a lift member which is substantially round in cross section.

15. The apparatus according to claim 1, wherein said lift member receptacle has an arcuate shape for receiving a curved lift member.

16. The apparatus according to claim 1, wherein said mounting plate has an arcuate rear surface whereby said mounting plate can be secured to a curved portion of said concrete mold.

17. An apparatus for supporting a lift member in a concrete mold, comprising:

a resilient member having a void forming portion and a lift member receptacle for releasably holding a lift member; and a mounting plate having a front surface and a rear surface and adapted for receiving said resilient member from said rear surface with said void forming portion extending from said front surface, said mounting plate having mounting structure on said rear surface for mounting to a concrete mold, wherein said resilient member comprises a base portion and two void forming elements extending from said base portion so as to define said void forming portion, each one of said two void forming elements having a surface facing the other of said two void forming elements so as to define a slot and said lift member receptacle therebetween, and further comprising a handle member having a handle portion and having two dowel members extending from said handle portion whereby said two dowel members extend into said void forming elements on either side of said lift member receptacle so as to exert a holding force through said resilient member to a lift member in said lift member receptacle.

18. The apparatus according to claim 17, wherein said handle member comprises two handle elements each having one of said two dowel members connected thereto, said handle elements being pivotable relative to each other between an engaging position wherein said two dowels exert said holding force and a release position wherein said dowels are pivoted away from each other.

* * * * *